United States Patent [19]

Williams

[11] Patent Number: 4,521,023

[45] Date of Patent: Jun. 4, 1985

[54] GOLF TRAINING DEVICE

[76] Inventor: Frank M. Williams, 121 W. Southington, Riverlee, Worthington, Ohio 43085

[21] Appl. No.: 554,889

[22] Filed: Nov. 25, 1983

[51] Int. Cl.[3] ..... A63B 69/36

[52] U.S. Cl. ..... 273/183 B; 273/190 R

[58] Field of Search ..... 273/183 B, 190 R, 188 R, 273/191 R, 191 A, 189 R; 434/252

[56] References Cited

U.S. PATENT DOCUMENTS

| | | | |
|---|---|---|---|
| 1,530,519 | 3/1925 | Remington | 273/188 R |
| 1,561,960 | 11/1925 | Ungar | 273/188 R |
| 2,611,610 | 9/1952 | Hara | 273/190 R |
| 2,626,151 | 1/1953 | Jenks | 273/190 R |
| 3,079,152 | 2/1963 | Gushing | 273/188 R |
| 3,415,523 | 12/1968 | Boldt | 273/190 R |
| 3,595,583 | 7/1971 | Oppenheimer | 273/191 R |
| 3,698,721 | 10/1972 | Stewart | 273/190 R X |
| 4,326,718 | 4/1982 | Kiehl | 273/190 R X |

*Primary Examiner*—George J. Marlo

*Attorney, Agent, or Firm*—Wood, Herron & Evans

[57] ABSTRACT

A golf training device is disclosed for teaching body movements during a golf swing designed to substantially maintain fixed the intersection of the user's torso axis with the user's body axis to thereby improve the user's swing. Relatively free body movement is permitted through use of the device, with the exception that the head of the user is constrained to rotate around the user's torso axis and to rotate about the user's body axis. Certain limited movement of the head along the body axis is permitted. Both the torso and body axes are established by the initial stance of the user, with the device serving to maintain the intersection of those two axes relatively constant throughout the golf swing. The device comprises a rigid upright carried on a base with a rigid arm extending from the upright and adjustably mounted thereto. A head movement control member includes a first shaft carried in a housing with the shaft mounted for free rotational head movement about the user's body axis and provides for limited movement along the same axis. A second shaft mounted eccentric to the first shaft permits free rotational head movement about the user's torso axis. A cap worn by the user is fixed to the second shaft with the two shafts thereby combining to constrain the movement of the user's head to promote an improved golf swing.

8 Claims, 2 Drawing Figures

GOLF TRAINING DEVICE

FIELD OF THE INVENTION

This invention generally relates to devices to aid golfers in improving their swings and, more particularly, to a golf training device which orients the head of a golfer to thereby teach an improved golf swing.

BACKGROUND OF THE INVENTION

There are a considerable number of golf aids which have been developed over the years with the general object to train a golfer to improve his golf swing. Such golf training devices have variously sought to teach improved golf swings by restraining torso movements, hip movements, shoulder movements, arm movements, and head movements. For example, U.S. Pat. Nos. 2,626,151; 3,415,523; and 3,698,721 show elaborate golf training devices having mechanisms for controlling the movement of the user's head.

I have made a study of the geometric elements of the golf swing including the user's body axis, the torso axis, and the inclinations of each of these axes with the ground. The body axis extends from the top of the head through a point midway between the outer surfaces of the eyes to a point on the ground midway between the balls of the feet. I have found that to make the best possible golf swing the length of this axis and its inclination with the ground should remain relatively unchanged throughout both the back swing and the down swing. The difficulty in doing just this can, of course, be observed in practice, often with the reiterated reminder "to keep the head down." Common errors which occur in making the swing include pulling up on the back swing and straightening up on the down swing.

When the body axis is viewed from the side, it may be seen that the only hip movement that will not result in lengthening or shortening of the body axis is a swing of the hips around the body axis. That is, by keeping the radius from the body axis to the hips relatively unchanged throughout the swing. Also, the body axis must not be lengthened or shortened by inclining or declining the head from its inclination at the address of the ball, or by moving the head forward or backward, side-to-side, or causing it to move up or down by changing the inclination of the torso axis.

The torso axis extends generally from around the top of the head to midway between the hip sockets. The respective rotations of the club, arms, shoulders and the torso around the torso axis provide the leverage to produce power for the swing. As the hips rotate, the lower end of the torso axis rotates around the body axis.

The torso axis and the body axis intersect at about the top of the head. I have found that movements around these two axes are to be managed and coordinated to keep the point of their intersection fixed as nearly as possible to thereby improve the golf swing. That is, an improved golf swing results where the inclination of the torso axis with the body axis remains unchanged during the swing, and the intersection point of the two axes remains substantially fixed from address through the conclusion of the swing. Keeping the point of intersection at the top of the head fixed excludes movement of the head up or down, left or right, and front or back during the swing. The head may however rotate around the torso axis and swing around the body axis. Sufficient rotation of the head around the torso axis is desirable to smoothly blend head and body movements. A better golf swing is also accomplished where rotations around the body and torso axes are as simple as possible, i.e., with little or no motion except rotary motion.

It is thus among the principal objects of this invention to provide a golf training device to maintain fixed the intersection of the user's torso axis with the user's body axis during a golf swing to thereby produce a better swing.

A further object of the invention is to provide such a device for maintaining fixed the intersection of the torso and body axes through the use of a mechanism which substantially constrains movement of the user's head to rotation about the torso axis and about the body axis, with only limited head movement along the body axis otherwise being permitted.

SUMMARY OF THE INVENTION

To these ends, the present invention provides a golf training device to teach body movements during a golf swing which will substantially maintain fixed the intersection of the user's torso axis with the user's body axis. The device includes a base or platform which carries a rigid upright. A rigid arm extends from the upright, which is height adjustable. A head movement control member for maintaining the intersection of the above-described axes is carried by the rigid arm.

The head movement control member includes a first movement axis control element having a first housing with a channel in which is received a first shaft. The first shaft is mounted for reciprocal (axial) movement in the channel, and is free to rotate about its axis therein. The shaft is biased against such reciprocal movement by a resilient spring member.

A second movement axis control element includes a second housing which is carried by the first movement axis control element, and has a second shaft rotatably carried by the second housing. The second shaft is fixed in use to a cap to be worn by the user. The first movement axis control element is in turn fixed to the arm.

The user places the cap on his or her head and adjusts the device in relation to a desired stance. The intersection of the user's body axis and torso axis is thus established by this initial adjustment. Movement of the user's head during the course of the swing is thereafter controlled by the first movement axis control element which constrains swinging movement of the user's head, and therefore the user's body, about the body axis, with limited movement being permitted along that same axis by the resiliently biased first shaft. The second axis control element constrains swinging movement of the user's head, and therefore the user's torso, about the torso axis. By constraining the head movement of the user, the established intersection of the user's body and torso axes is thus substantially maintained fixed throughout the swing, giving the user a feel for a proper swing movement and inducing an improved golf swing.

In a presently preferred embodiment of the invention, the first movement axis control element comprises a cylindrical housing having an interior chamber formed therein. A first shaft is received in the chamber of this first housing and is freely rotatable about its axis therein. Reciprocal movement of the first shaft is provided which is limited by a spring which at one end bears against a cap closing the chamber. The other end of the spring is carried in a spring supporting member which is spaced by a thrust bearing from the end of the first shaft extending into the chamber. A cylindrical bearing sleeve surrounds a portion of the first shaft in the first housing. The first shaft is thus free to rotate, with limited reciprocal movement along its axis.

A second cylindrical shaped housing is mounted eccentric to the first shaft. A second shaft is received within the second housing, and is likewise provided with bearings to be freely rotatable therein. The second shaft in use is fixed to a cap, such as a construction-type helmet, which is worn by the user.

The first housing is mounted to the arm with the first shaft extending generally along the body axis of the user, with the second housing fixed at an angle to the first shaft with the second shaft extending generally along the user's torso axis.

Preferably, the body axis lies at an angle of 12½° to the vertical at the point of intersection of the body and torso axes. The torso axis lies at an angle of 30° to the vertical. This makes the angle of intersection between the torso and body axes 17½°.

Each shaft is thus free to rotate about its respective axis but is otherwise constrained against any other movement, except for the limited reciprocal movement of the first shaft along the body axis. The user's head is likewise constrained from movement by this device. In this way, the intersection of the user's torso and body axes is maintained substantially fixed throughout a golf swing, thereby serving to give the user a feel for proper movement in a golf swing.

DETAILED DESCRIPTION OF THE INVENTION

Figure 1:
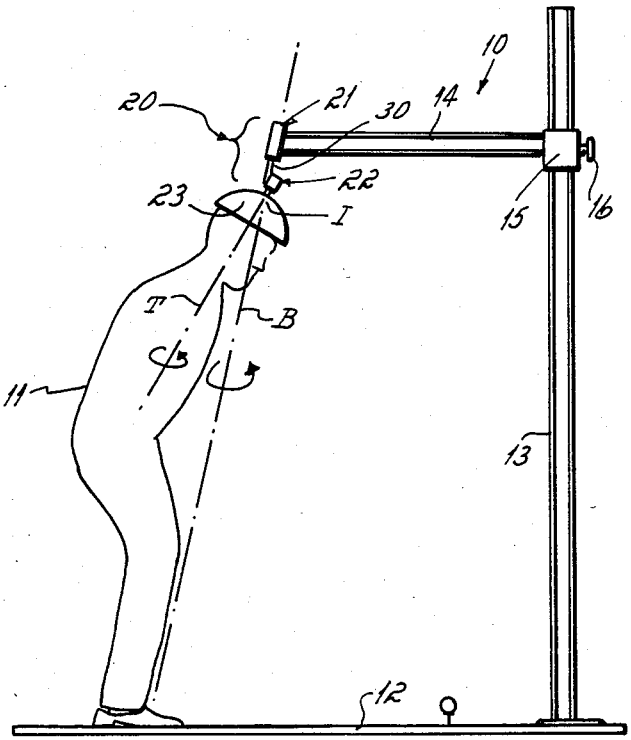
FIG. 1 is a side elevational view of one form of the golf training device of this invention with a golfer's body shown schematically, and with the torso and body axes delineated.

FIG. 1 shows a golf training device 10 with a golfer or user 11 shown schematically in a typical stance for a golf swing. The body axis B of the golfer 11 extends from approximately the top of the head through a point midway between the outer surfaces of the eyes to a point on the ground midway between the balls of the feet. The torso axis T extends from about the top of the head through a point midway between the hip sockets. The imaginary torso T and body B axes intersect at a point I adjacent the top of the head. It is the maintenance of this intersection I of the user's torso axis T with the user's body axis B throughout the golf swing from address to followthrough which the golf training device of this invention is designed to teach.

Preferably, the body axis lies at an angle of 12½° to the vertical at the point of intersection of the body and torso axes. The torso axis lies at an angle of 30° to the vertical. This makes the angle of intersection between the torso and body axes 17½°.

The golf training device 10 includes generally a base or foundation 12 and a rigid upright 13 which is fixed to the base 10, e.g., by welding or bolting it thereto. A rigid arm 14 extends generally horizontally from the upright 13. The arm 14 is adjustably mounted to the upright 13, as by sliding clamp 15 having a fixing screw 16. The upright 13 may have gradation marks thereon to indicate various heights of the arm 14 to facilitate minor adjustments and for positioning of the arm 14. A reference scale may also be formed on an extended foundation 12, or the ground, for ready positioning of the feet. The reach of the arm 14 should be adequate to provide sufficient space from the upright 13 to allow full freedom for the golfer's swing. Metal I-beams have been used for both the upright 13 and arm 14.

A head movement control member 20 maintains substantially fixed the point of intersection I of the user's torso axis T with the user's body axis B during a golf swing. In this illustrated embodiment, the head movement control member 20 has a first movement axis control element 21 for controlling head movement around the body axis B, and a second movement axis control element 22 for controlling head movement around the torso axis A. A hat or cap 23 is fixed to the second element 22. The cap 23 is preferably one such as a construction-type helmet, having interior load bearing straps and an adjustable head-band for load transfer between the user 11 and the device 10.

Figure 2:
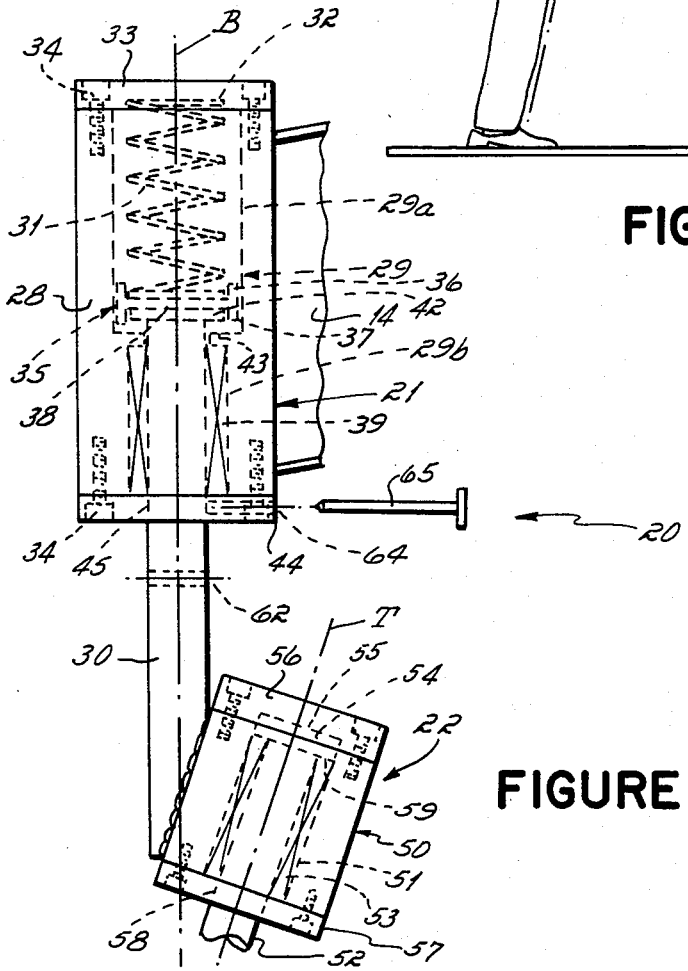
FIG. 2 is a cross-sectional view of the head movement control member of the golf training device shown in FIG. 1.

Referring now to FIG. 2, the first movement axis control element 21 has a cylindrically shaped housing 28 formed from mild steel (40,000 psi), for example. The housing 28 has an interior chamber 29 having a major upper chamber portion **29*a* and a minor chamber portion 29*b*. A shaft 30 formed, e.g., out of metal rod stock, is received in the chamber 29**.

The shaft 30 is free to rotate within the housing 28 and has limited reciprocal movement therein. This limited reciprocal movement is provided by a compression spring 31, e.g., a simple spiral spring, which is mounted in the major chamber portion **29*a*. The spring 31 is received in a recess 32 formed in an end cap 33 which closes one end of the housing 28. Screws 34 may be used to fix end cap 33 to the housing 28. The other end of the spring 31 is received in a spring support member 35, which is provided with an upper lip 36** to locate the spring.

Supporting member 35 is free to slide along the generally smooth walls of the major chamber **29*a*. A lower lip 37 locates a thrust bearing 38** therein such as an oil impregnated thrust bearing.

Thrust bearing 38 permits free rotation of the shaft 30 within a cylindrical bearing sleeve 39 which is mounted within the bearing conforming minor chamber portion **29*b*. Widened head 42 of the shaft 30 bears against the thrust bearing 38 when the shaft 30 is moved axially against the force of the compression spring 31. The combination of the cylindrical bearing sleeve 39 and the thrust bearing 38 thus permits free rotation of the shaft 30, with insignificant rotational forces applied to the spring 31. Freedom of rotation of the shaft 30** provided by these bearing surfaces yields relatively free rotation of the user's head about the body axis B with no significant resistance torque to the user's neck.

An interior shoulder 43 is formed in the chamber 29 between chamber portions **29*a* and 29*b*. This shoulder 43 keeps the head 42 of the shaft 30 within the major chamber portion 29*a* and serves as the lower limit to its reciprocal movement. The shoulder 43 also fixes the cylindrical bearing sleeve 39 in position. End cap 44 closes the other end of the cylindrical housing 28 and has an axial through bore 45 through which shaft 30 passes. End cap 44, like end cap 33, is fixed in place, e.g., by screws 34**.

Housing 28 is securely fastened to the arm 14, e.g., by the use of bolts (not shown) or by welding. In this embodiment, the housing 28 is fixed at an angle relative to the arm 14 such that the shaft 30 extends generally along the user's body axis B (FIG. 1). Generally, the location of this body axis B will be relatively constant from one individual to another, as will the angle between the torso axis T and the body axis B. Means may of course be provided to make the housing 28 adjustable on the arm 14.

A second movement axis control element 22 is fixed to the end of the shaft 30 extending out of the housing 28. The second movement axis control element 22 has a cylindrical housing 50 made, e.g., of mild steel, and having an interior chamber 51. A second shaft 52 of metal rod stock is rotatably received within the chamber 51, by means of a cylindrical bearing sleeve 53. A thrust bearing 54 is received in a recess 55 formed in an end cap 56 which closes one end of the second housing 50. The other end of the housing 50 is closed by opposite end cap 57 which is provided with a through bore 58 through which the shaft 52 extends. In this embodiment, shaft 52 is fixed against all but rotational movement with the extended head 59 of the shaft 52 bearing against the thrust bearing 54 and captured therebetween by the top of the cylindrical bearing sleeve 51.

The second housing 50 is fixed to the first shaft 30, e.g., by welding. The second housing 50 is fixed at an angle to the first shaft 30, such that the shaft 52 extends generally along the torso axis T of the user.

Shaft 52 is fixed, e.g., by welding or bolting, to the crown of cap 23. Of course, the cap 23 may be made detachable from the shaft 52, if desired, as long as it is fixed to the shaft 52 in use.

In operation, the golfer takes a position in a stance directly underneath the cap 23. The cap 23 is then lowered into place by moving the arm 14 along the upright 13. It has been found desirable to initially load the compression spring 31 of the first movement axis control member 20 to provide an initial pressure of the cap 23 against the user's head. To this end, bore 62 is provided in the first shaft 30. A small through bore 64 is provided through the end cap 44 of housing 28 which aligns with the bore 62 when the shaft 30 is moved axially to compress the spring 31. A pin 65 can then be inserted through through bore 64 into the bore 62 to hold the shaft 30 in position with the spring 31 being slightly compressed while the user positions the cap on his head. When the cap 23 has been snugly positioned on the user's head, the pin 65 is then removed. The spring 31 expands thereby placing an initial pressure on the user's head.

A few preliminary waggles and swings may be taken for additional adjustments, if necessary. A compression spring rated at 25 pounds maximum compression has been used with the initial loading of the spring to about half the distance of travel of the shaft 30 within the chamber portion 29*a*.

As stated, shaft 30 of the first movement axis control element 21 extends along body axis B. Upward movement of the head along the axis B is resisted by increasing spring compression, and it is completely limited by full compression. Movement of the head downward is indicated by the release of spring compression and disengagement of the head from the cap 23.

Besides the limited head movement along the body axis B, head movement is substantially limited to the rotation about the body axis B and torso axis T. This rotation is controlled by head movement control member 20. First movement axis control element 21 constrains head rotation about the body axis B, and second head movement axis control element 22 constrains head rotation about the torso axis T. Movements around these two axes are thus managed and coordinated by the device 10 to keep the point I of the intersection of the axes from substantial movement in any direction. Use of this device thus gives the user a feel for a swing which properly maintains this intersection I of body B and torso T axes, and thereby improves the user's golf swing.

While the invention has been described in connection with a certain presently preferred embodiment, it will be understood by to those skilled in the art that many modifications of structure, arrangement, portions, elements, materials and components can be used in the practice of this invention without departing from the principles of this invention.

What is claimed is:

1. A golf training device to teach body movement during a golf swing which substantially maintains fixed the intersection of the user's torso axis and the user's body axis, said torso axis being defined as a line extending generally through the top of the user's head and a point midway between the user's hips, said body axis being defined as a line extending generally through a point midway between the outer surfaces of the user's eyes to a point midway between the balls of the user's feet, said axes intersecting at a point about at the top of the user's head, said device comprising:

a rigid arm adapted to be fixedly located in a generally horizontal orientation, and head control means carried by the arm, said head control means comprising a cap for the user's head, first means for restricting head movement to free rotation about said body axis, and including resilient means for limited head movement along said body axis, and second means for restricting head movement to free rotation about said torso axis, said second means being fixed with respect to the first means, said head control means being operative to maintain substantially fixed the point of intersection of said torso and body axes during the user's golf swing.

2. The golf training device of claim 1, wherein said first means comprises a first shaft received in a first housing and being reciprocal therein generally along said body axis, said first shaft being freely rotatable about said body axis, and said second means comprises a second shaft received in a second housing generally along said torso axis and being freely rotatable therein about said torso axis.

3. The golf training device of claim 2, wherein said resilient means comprises a coil spring and the device further comprises bearing means in said first housing, one end of said spring bearing against said bearing means and said bearing means in turn bearing against one end of said first shaft to thereby bias said first shaft against axial movement in said first housing while permitting free rotation of said first shaft about its axis without torquing of said spring.

4. The golf training device of claim 2, further comprising lock means for releasably locking said first shaft in place with said resilient means under compression to provide an initial spring load force on said first shaft pressing the cap against the user's head in use.

5. The golf training device of claim 1 wherein said body axis lies at an angle of about 12½° to the vertical and wherein the torso axis intersects the body axis at an angle of about 17½°.

6. A golf training device to teach body movement during a golf swing which substantially maintains fixed the intersection of the user's torso axis and the user's body axis, said torso axis being defined as a line extending generally through the top of the user's head and midway between the user's hips, said body axis being defined as a line extending generally through a point midway between the outer surfaces of the user's eyes to a point midway between the balls of the user's feet, said axes intersecting at a point about at the top of the user's head, said device comprising:

a rigid upright, a rigid arm movable on and extending generally horizontally from said upright, a head movement control member comprising, first movement axis control means for constraining movement of the user's body to rotation about said body axis with limited axial movement along that axis comprising a first housing having a channel, a first shaft received in said first housing for reciprocal movement in said channel generally along said body axis and being freely rotatable therein about said body axis, said first housing being carried by said arm, and means for biasing said first shaft against such reciprocal movement, second movement axis control means for constraining free movement of the user's torso about said torso axis comprising a second housing carried by said first movement axis control means, and a second shaft received in said second housing generally along said torso axis and freely rotatable therein about said torso axis, and a cap to be worn by the user connected to said second shaft, said axes control means cooperating to substantially maintain fixed the point of intersection of said body axis and said torso axis during the user's golf swing.

7. The golf training device of claim 6 wherein said body axis lies at an angle of about $12\frac{1}{2}°$ to the vertical and wherein the torso axis intersects the body axis at an angle of about $17\frac{1}{2}°$.

8. A golf training device to teach body movement during a golf swing which substantially maintains fixed the intersection of the user's torso axis and the user's body axis, said torso axis being defined as a line extending generally through the top of the user's head and a point midway between the user's hips, said body axis being defined as a line extending generally through a point midway between the outer surfaces of the user's eyes to a point midway between the balls of the user's feet, said axes intersecting at a point about at the top of the user's head, said device comprising:

a rigid upright, a rigid, horizontally extending arm adjustably carried by said upright, and a head control member comprising:

a first housing having an interior chamber, a spring located within said chamber, said first housing chamber having a bearing surface against which said spring bears, a first shaft received in said first housing chamber generally along said body axis and being reciprocable therein along said body axis, said first shaft being biased against such reciprocable movement by said spring, first bearing means permitting relatively free rotation of said first shaft in said chamber about said body axis, a second housing fixed to said first shaft and having an interior chamber with a bearing surface therein, a second shaft received in said second housing chamber generally along said torso axis, said second shaft being relatively freely rotatable in said second chamber about said torso axis, a cap for the user's head, the cap being fixed to said second shaft, said head control means being operative to maintain substantially fixed the point of intersection of said torso and body axes during the user's golf swing.

* * * * *